US008272720B2

(12) United States Patent
Hattori

(10) Patent No.: US 8,272,720 B2
(45) Date of Patent: Sep. 25, 2012

(54) STORAGE DEVICE FOR STORING LIQUID CONTAINER AND LIQUID CONTAINER FOR USE WITH THE SAME

(75) Inventor: Shingo Hattori, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 702 days.

(21) Appl. No.: 12/055,260

(22) Filed: Mar. 25, 2008

(65) Prior Publication Data

US 2008/0239036 A1 Oct. 2, 2008

(30) Foreign Application Priority Data

Mar. 30, 2007 (JP) ..... 2007-095663

(51) Int. Cl.
*B41J 2/175* (2006.01)
*B41J 2/17* (2006.01)

(52) U.S. Cl. ..... 347/86; 347/84; 347/85

(58) Field of Classification Search ..... 347/49, 347/84–87

See application file for complete search history.

(56) References Cited

U.S. PATENT DOCUMENTS

| | | | | |
|---|---|---|---|---|
| 5,512,926 | A | 4/1996 | Uchikata et al. | |
| 5,534,899 | A | 7/1996 | Uchikata et al. | |
| 6,003,985 | A | 12/1999 | Bekki | |
| 6,070,975 | A | 6/2000 | Uchikata et al. | |
| 6,547,363 | B1 | 4/2003 | Shinada et al. | |
| 7,033,009 | B2 | 4/2006 | Shinada et al. | |
| 2003/0137568 | A1 * | 7/2003 | Shinada et al. | 347/86 |
| 2003/0222940 | A1 | 12/2003 | Seino et al. | |
| 2005/0157102 | A1 * | 7/2005 | Silverbrook | 347/85 |
| 2007/0070147 | A1 * | 3/2007 | Hattori et al. | 347/86 |
| 2007/0120901 | A1 | 5/2007 | Sugiyama et al. | |
| 2007/0229631 | A1 * | 10/2007 | Yano | 347/87 |

FOREIGN PATENT DOCUMENTS

| | | | |
|---|---|---|---|
| JP | H05-162323 | A | 6/1993 |
| JP | 2006-116784 | A | 5/2006 |
| JP | 2006-123563 | A | 5/2006 |
| JP | 2007-144942 | A | 6/2007 |
| WO | 0105596 | A1 | 1/2001 |

* cited by examiner

*Primary Examiner* — Charlie Peng
*Assistant Examiner* — Hung Lam
(74) *Attorney, Agent, or Firm* — Baker Botts L.L.P.

(57) ABSTRACT

A storage device includes a case configured to mount a liquid container. The storage device includes: a lever configured to move among a first position, a second position, and a third position between the first position and the second position; a first member movable between a protruding position to restrict an insertion of the liquid container at a particular position, and a retracted position that allows the liquid container to be inserted to a mounted position; a link member configured to change the position of the first member from the protruding position to the retracted position when the lever moves from the first position to the third position; and a second member. When a liquid container which is pre-assigned to the case is inserted into the case, the second member allows a positional change of the lever from the first position to the third position.

12 Claims, 13 Drawing Sheets

STORAGE DEVICE FOR STORING LIQUID CONTAINER AND LIQUID CONTAINER FOR USE WITH THE SAME

CROSS-REFERENCE TO RELATED APPLICATIONS

This application is based upon and claims priority from Japanese Patent Application No. 2007-095663, filed on Mar. 30, 2007, the entire contents of which are incorporated herein by reference. This application is also related to U.S. patent application Ser. No. 11/959,404, filed on Dec. 28, 2007, which is hereby incorporated by reference.

TECHNICAL FIELD

The present invention generally relates to a devices for storing liquid containers, and specifically, to devices for storing liquid containers wherein the device have a mechanism for preventing liquid containers from being erroneously inserted, and liquid containers for use with the same.

BACKGROUND

An ink-jet recording apparatus (hereinafter, referred to simply as a "recording apparatus") that records images on a recording medium, i.e., a recording sheet of paper in ink is widely known. The recording apparatus includes an ink-jet type recording head. The recording head selectively jets ink supplied to the recording head onto the recording sheet from nozzles. As a result, an image is recorded on the recording sheet. The recording apparatus further includes a mounting portion to which an ink cartridge is mounted. The ink cartridge is removably mounted to the mounting portion. Ink can be supplied to the recording head from the ink cartridge mounted to the mounting portion.

A recording apparatus capable of performing color printing uses a plurality of color inks such as black ink, yellow ink, cyan ink, and magenta ink. These color inks are stored in ink cartridges corresponding to the respective colors. The recording apparatus also has multiple cases for storing the ink cartridges storing the plurality of colors inks, respectively. Therefore, each case is designed to receive an ink cartridge of a particular color.

In the recording apparatus using such color inks, it is necessary to mount each ink cartridge to a proper respective one of the cases. If an ink cartridge of a particular color is mounted to a case that does not correspond to the ink cartridge of the particular color, colors will be mixed, which noticeably lowers image quality. Moreover, when two kinds of ink cartridges, one of which stores pigment-based black ink and the other of which stores dye-based black ink, are mounted to one recording apparatus, the mounting of an ink cartridge to a wrong case is liable to occur.

Therefore, a mechanism that prevents insertion of an inappropriate ink cartridge into a given mounting portion is provided in a known recording apparatus. In this recording apparatus, the insertion of an ink cartridge is temporality blocked in a given position before the ink cartridge is completely mounted to the mounting portion. Information is read from an IC memory mounted on the ink cartridge when the ink cartridge is in the given position. Based on the information read therefrom, a determination is made as to whether the ink cartridge is a proper one to be inserted and mounted to the mounting portion. If a determination is made that the ink cartridge is a proper one to be mounted, the blockage of insertion is removed such that the ink cartridge is allowed to be mounted to the mounting portion. Such a known recording apparatus is described in WO 01/005596 A1 for example.

Nevertheless, in the recording apparatus described above, it is necessary to mount an IC memory on the ink cartridge and to provide an IC-memory reading device on the recording apparatus. Therefore, not only the structure of the ink cartridge but also the structure of the recording apparatus becomes complicated. In addition, the cost of products is increased. The IC memory is also susceptible to environmental damage. For example, in an environment in which an ink mist might hang in the air or in which ink leakage from the ink cartridge might be caused, drops of ink might adhere to the IC memory. If so, information may not be read from the IC memory correctly, and, even if a proper ink cartridge is inserted into the mounting portion, a false determination may be made that an ink cartridge has been erroneously inserted.

SUMMARY

Aspects of the present invention have been made in consideration of these circumstances. It is therefore an object of the aspects of the present invention to provide a storage device for storing a liquid container, the storage device being capable of preventing a liquid container from being erroneously inserted by use of a simple mechanism and with reliability, and to provide a liquid container for use with the storage device.

According to an aspect of the invention, there is provided a storage device for storing a liquid container, the storage device comprising: a case configured to mount a liquid container therein at a mounted position, the case having an insertion opening and an insertion path formed therein to allow the liquid container to be inserted from the insertion opening in an insertion direction to the mounted position through the insertion path; a lever attached to the case and configured to move among a first position in which the lever is separated from the insertion opening such that the liquid container is allowed to be inserted into the case from the insertion opening, a second position in which the liquid container having been inserted into the case is pressed by the lever such that the liquid container is positioned in the mounted position, and a third position between the first position and the second position, wherein the lever moves from the first position to the second position when the lever moves toward the insertion opening; a first member configured to move between a protruding position in which the first member protrudes into the insertion path to restrict an insertion of the liquid container into the case at a particular position before the liquid container is inserted to the mounted position, and a retracted position in which the first member is retracted from the insertion path to allow the insertion of the liquid container up to the mounted position; a link member configured to change a position of the first member from the protruding position to the retracted position when the lever moves from the first position to the third position; and a second member configured to allow a positional change of the lever from the first position to the third position when a liquid container that is pre-assigned to the case is inserted thereinto and to prevent the positional change of the lever from the first position to the third position when a liquid container that is not pre-assigned to the case is inserted thereinto.

According to another aspect of the invention, there is provided a liquid container for use with a storage device, the storage device comprising a case configured to mount a liquid container therein at a mounted position, the case having an insertion opening and an insertion path formed therein to allow the liquid container to be inserted from the insertion opening in an insertion direction to the mounted position through the insertion path; a lever attached to the case and configured to move among a first position in which the lever is separated from the insertion opening such that the liquid container is allowed to be inserted into the case, a second position in which the liquid container having been inserted into the case is pressed by the lever such that the liquid container is positioned in the mounted position, and a third position between the first position and the second position, wherein the lever moves from the first position to the second position when the lever moves toward the insertion opening; a first member configured to move between a protruding position in which the first member protrudes into the insertion path to restrict an insertion of the liquid container into the case at a particular position before the liquid container is inserted to the mounted position, and a retracted position in which the first member is retracted from the insertion path to allow the insertion of the liquid container up to the mounted position; and a link member configured to change a position of the first member from the protruding position to the retracted position when the lever moves from the first position to the third position, the liquid container comprising: a second member disposed at a corresponding position to a case of a storage device which is pre-assigned to the liquid container and configured to allow a positional change of the lever from the first position to the third position when the liquid container is inserted to the case that is pre-assigned to the liquid container and to prevent the positional change of the lever from the first position to the third position when the liquid container is inserted to a case that is not pre-assigned to the liquid container.

BRIEF DESCRIPTION OF THE DRAWINGS

The above and other features and advantages of the present invention will become more apparent by describing in detail illustrative aspects thereof with reference to the attached drawings in which.

DESCRIPTION OF EMBODIMENTS

Embodiments of the present invention will be hereinafter described appropriately with reference to the attached drawings. Note that the embodiments described hereinafter are merely examples in which the present invention is embodied, and needless to say, the embodiments may be varied or modified without departing from the spirit of the present invention. Moreover, embodiments of the present invention are described in relation to an example of an ink jet cartridge as the liquid container. However, one of ordinary skill in the art will appreciate that the storage device for storing liquid containers according to the present invention would be applicable to any liquid container in which identification of the liquid container within the storage device would be advantageous. For, example, the liquid container may be suitable for supplying a liquid to a liquid ejecting apparatus. For example, the liquid ejecting apparatus may include a liquid ejecting head (a print head) of an ink jet type recording apparatus, a coloring agent ejecting head of a color filter manufacturing apparatus for manufacturing a color filter of a liquid crystal display, an electrode material (conductive paste) ejecting head for forming an electrode of an organic EL display or an FED (a surface emitting display), and furthermore, a bioorganism ejecting head of a biochip manufacturing apparatus for manufacturing a biochip and a specimen ejecting head to be a precision pipette. In other words, embodiments can be varied or modified without departing from the scope of the present invention as defined by the appended claims.

Figure 1:
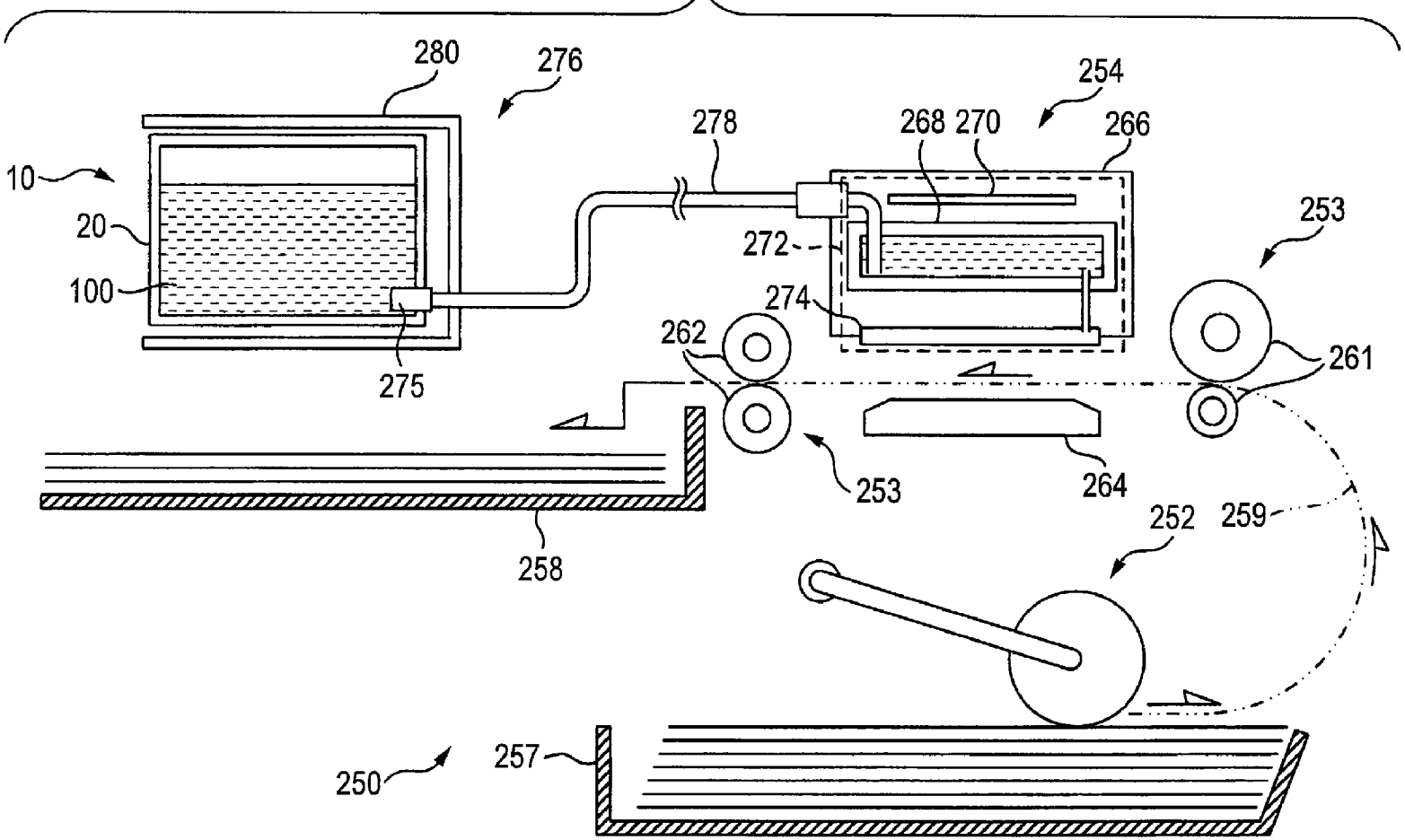
FIG. 1 is a schematic sectional view of an internal mechanism of a recording apparatus according to an embodiment of the present invention.

First, referring to FIG. 1, a description will be given of a schematic structure of an ink-jet type recording apparatus and the operation thereof according to an embodiment of the present invention.

A recording apparatus 250 records a color image or a monochromatic image on a recording medium such as a sheet of paper by use of a plurality of color inks, for example, by use of four color inks including black (BK) ink, yellow (Y) ink, cyan (C) ink, and magenta (M) ink. As shown in FIG. 1, the recording apparatus 250 includes a sheet feeding device 252, a sheet conveying device 253, a recording unit 254, and a storage device 276. The storage device 276 is an example of the storage device for storing liquid containers according to an embodiment of the present invention. However, one of ordinary skill in the art will appreciate that the storage device according to the present invention would also be applicable for storing other types of liquid containers for which it would be advantageous to be able to identify whether the liquid container was properly inserted. A sheet feeding tray 257 is disposed at the bottom of the recording apparatus 250. Recording sheets of paper stacked in the sheet feeding tray 257 are fed to a conveying path 259 by the sheet feeding device 252.

The sheet conveying device 253 is disposed in the conveying path 259. The sheet conveying device 253 has a conveying roller pair 261 and a conveying roller pair 262. The conveying roller pair 261 is disposed on the upstream side (i.e., on the right-hand side in FIG. 1) in the conveying direction with respect to the recording unit 254. In addition, the conveying roller pair 262 is disposed on the downstream side (i.e., on the left-hand side in FIG. 1) in the conveying direction with respect to the recording unit 254.

A recording sheet of paper fed to the conveying path 259 is conveyed by the conveying roller pair 261 toward a platen 264. The recording unit 254 is disposed above the platen 264. An image is recorded on the recording sheet passing on the platen 264 by means of the recording unit 254. The recording sheet that has passed across the platen 264 is discharged into a sheet discharging tray 258 disposed on the downmost-stream side of the conveying path 259 by means of the conveying roller pair 262.

The recording unit 254 has a carriage 266, which also serves as a frame of the recording unit 254, and a recording head 272. The recording head 272 includes sub-tanks 268, ahead control board 270, and nozzles 274. The carriage 266 is supported slidably in a direction perpendicular to the paper of FIG. 1 by means of, for example, supporting rails (not shown). Liquid to be supplied to the nozzles 274 is stored in the sub-tank 268. When an image signal is input into the head control board 270, liquid is jetted from the nozzles 274 toward a recording sheet, based on this image signal. The recording apparatus 250 additionally includes a main controller (not shown) that controls and supervises the recording apparatus 250. The image signal is output from this main controller, and is input into the head control board 270.

A plurality of liquid containers 10 are removably mounted to the storage device 276. More specifically, in the embodiment of the present invention shown in FIGS. 3A and 3B, liquid containers 10BK, 10Y, 10C, and 10M filled with four color inks, i.e., black ink, yellow ink, cyan ink, and magenta ink, respectively, are mounted to the storage device 276. The storage device 276 has four cases 280 (280BK, 280Y, 280C, and 280M in FIG. 7) corresponding to the four liquid containers 10, respectively. A liquid container 10 can be inserted into and be removed from a respective case 280 of the storage device 276. Each liquid container 10 has a main body 20 including an ink chamber 100. Liquid contained in the chamber 100 is supplied from the chamber 100 to a respective one of the sub-tanks 268 through a tube 278.

Referring to FIG. 2 to FIG. 6, a detailed description will be hereinafter given of a structure of a liquid container according to an embodiment of the present invention.

Figure 3A:
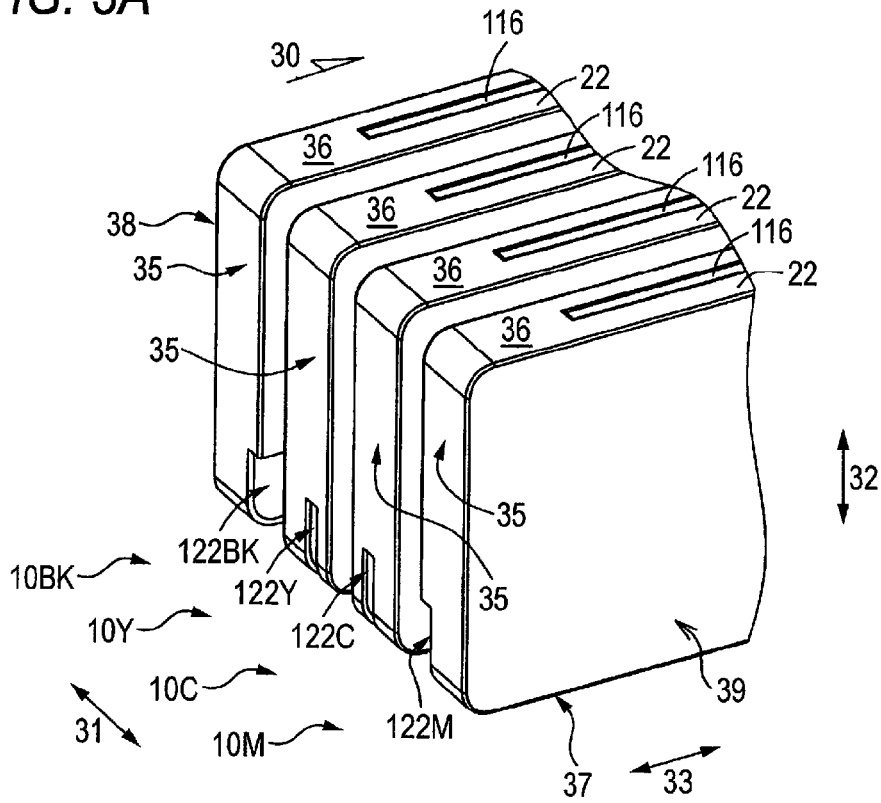
FIGS. 3A and 3B are perspective and rear views, respectively, of a structure of a back wall of a housing of a liquid container according to an embodiment of the present invention.

In this embodiment, the storage device 276 is configured to receive four liquid containers 10BK, 10Y, 10C, and 10M (see, e.g., FIG. 3A). Each of the liquid containers 10BK, 10Y, 10C, and 10M has a similar structure, except that these cartridges differ from each other in a position of a slit 122 (see FIG. 3A) which will be described in more detail later. Therefore, a description of the structure of each of the liquid containers 10BK, 10Y, and 10C will be hereinafter omitted. Note that the slit 122 of each of the liquid containers 10BK, 10Y, 10C, and 10M will be described in detail later.

Figure 2:
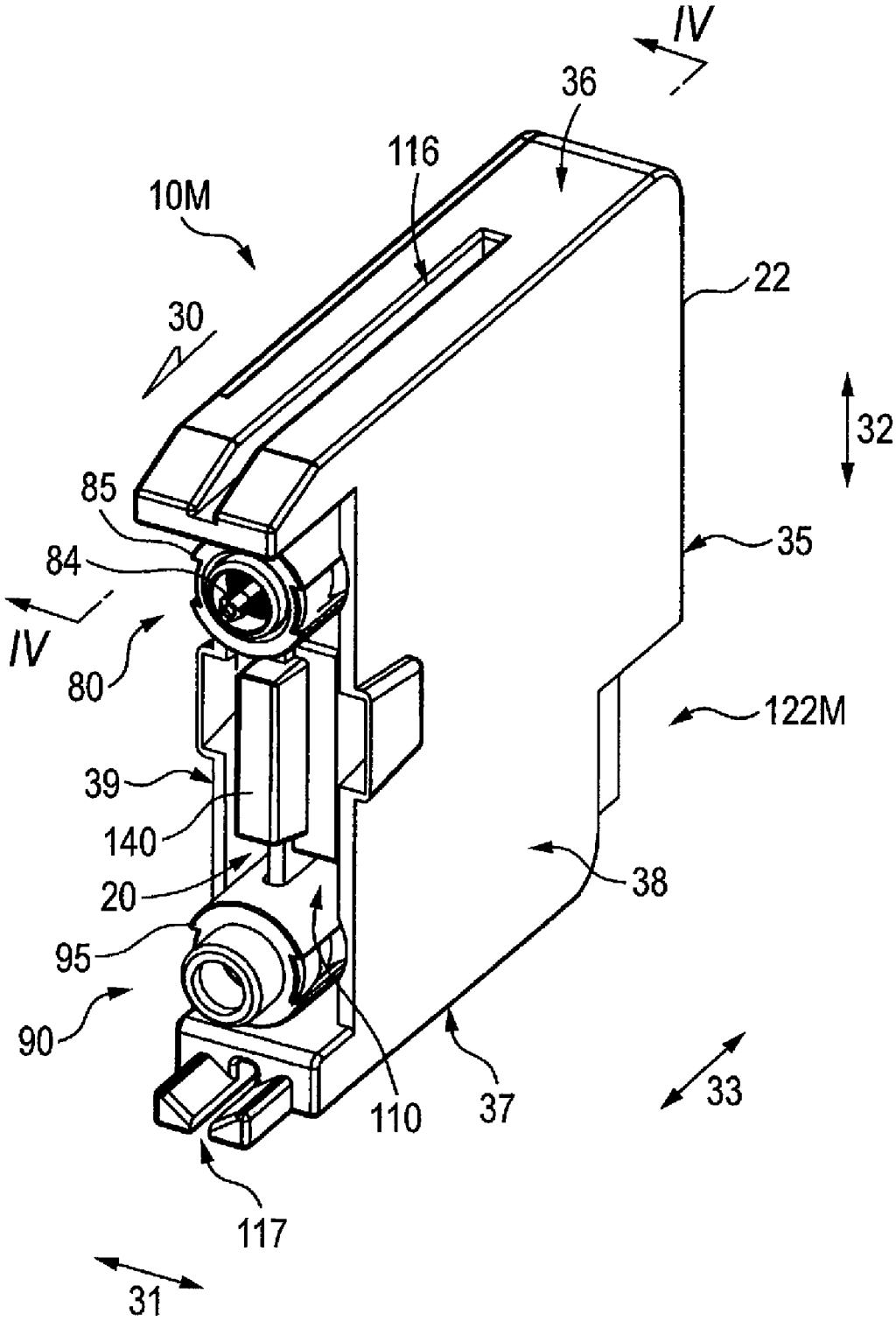
FIG. 2 is a perspective view of a liquid container according to an embodiment of the present invention.

As shown in FIG. 2, the liquid container 10M has a flat, substantially hexahedral shape. In more detail, the liquid container 10M has a substantially rectangle shape which is short in the width direction i.e., in the direction of a double-sided arrow 31, and which is longer in the height direction, i.e., in the direction of a double-sided arrow 32 and in the depth direction, i.e., in the direction of a double-sided arrow 33 than in the width direction.

Figure 4A:
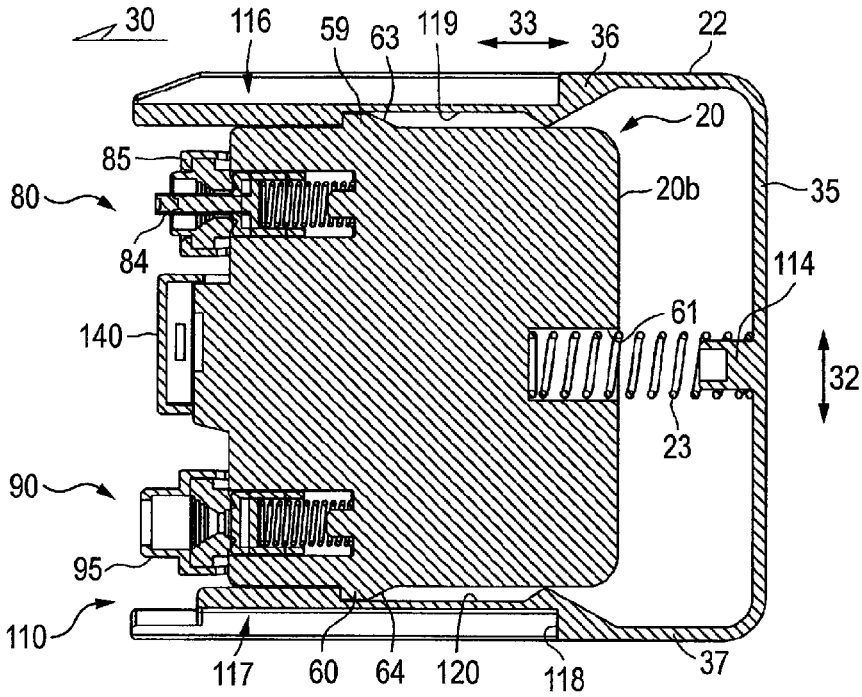
FIGS. 4A and 4B are cross-sectional views along a line IV-IV of FIG. 2, in which a coiled spring has expanded and contracted, respectively.
Figure 4B:
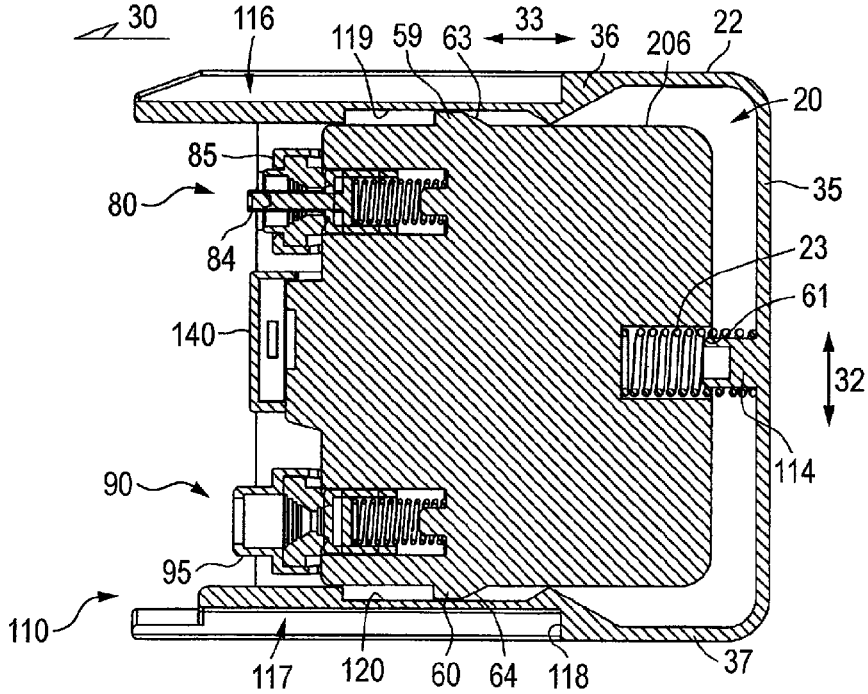

The liquid container 10M includes an upper wall 36 and a lower wall 37. FIGS. 2, 4A and 4B show the liquid container 10M in a standing position. In the standing position, the upper wall 36 extends in a substantially horizontal direction and is positioned facing upward, and the lower wall 37 extends in a substantially horizontal direction and is positioned facing downward. The liquid container 10M is inserted in a direction shown by an arrow 30 (hereinafter, this direction is referred to as an "insertion direction 30") into the storage device 276 in the standing position.

The liquid container 10M includes a main body 20, a housing 22, and an elastic member, e.g., a coiled spring 23 (see, e.g., FIG. 4). The housing 22 defines the exterior of the liquid container 10M. The housing 22 covers an entire portion of the main body 20 except for a front face 41 on the forward side in the insertion direction of the main body 20 (hereinafter, the portion of the main body covered by the housing 22 is referred to as a "rear portion" 20*b*) (see, e.g., FIG. 4A). Therefore, the rear portion 20*b* is protected by the housing 22. The main body 20 and the housing 22 are made of a resin material, such as a nylon, polyethylene, or polypropylene.

In this embodiment, the main body 20 is slidably supported in the housing 22. In addition, the coiled spring 23 (see, e.g., FIG. 4A) is placed between the main body 20 and the housing 22. The main body 20 can be slid within the range of expansion and contraction of the coiled spring 23. The structure of the main body 20, the structure of the housing 22, and a sliding mechanism will be described in detail below.

Figure 5:
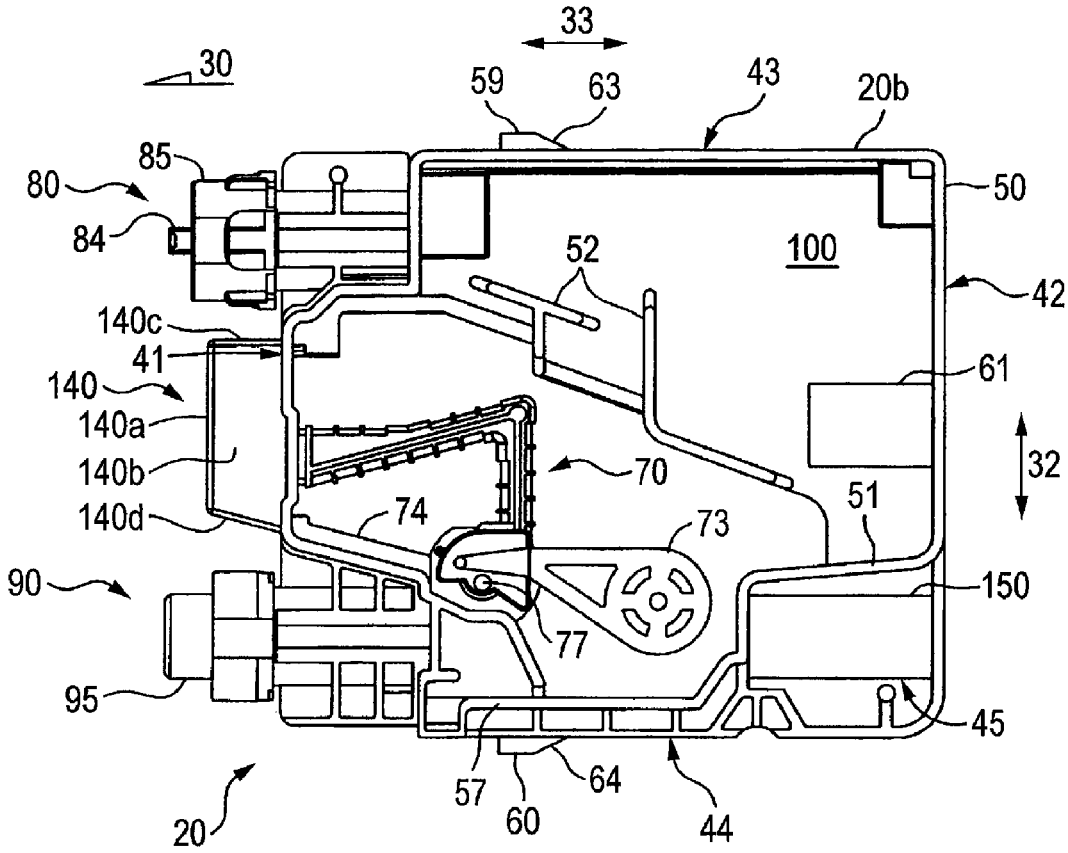
FIG. 5 is a side view of a main body according to an embodiment of the present invention.
Figure 6:
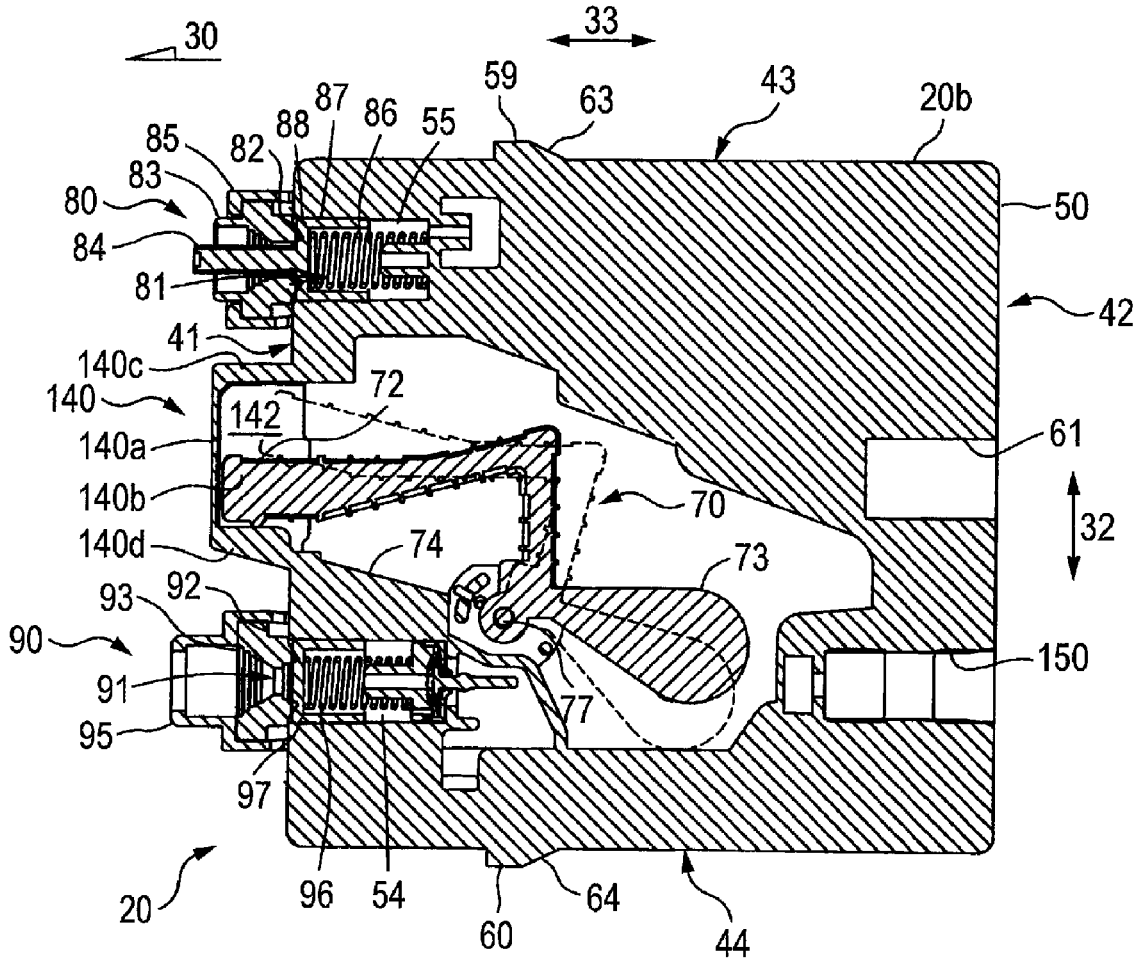
FIG. 6 is a cross-sectional view of the main body taken along a plane parallel to an arrow 32 and arrow 33 of FIG. 5.

First, the structure of the main body 20 will be described in detail. As shown in FIG. 5, the main body 20 has a flat, substantially hexahedral shape, and an external shape of the main body 20 substantially corresponds to the external shape of the liquid container 10M. The main body 20 is stored in a corresponding case 280M in a standing position as shown, for example, in FIG. 5. As shown in FIG. 5 and FIG. 6, in this embodiment, the main body 20 has six faces, i.e., a front face 41, a rear face 42, a top face 43, a bottom face 44 and left and right side faces 45, which are respectively faces on the forward side, rearward side, upper side, lower side and left and right sides with respect to the insertion direction 30. Each of the side faces 45 is connected to the front face 41, the rear face 42, the top face 43, and the bottom face 44. Concerning the side faces 45, the left side face and the right side face are respectively located on the left-hand side and the right-hand side as viewed from the rear face 42. In this embodiment, an area of each of the side faces 45 has the maximum area of the six faces of the main body 20.

As shown in FIG. 5, the main body 20 includes a frame 50, a sensor arm 70, an atmospheric introduction valve 80, a liquid supply cover member, e.g., an ink supply valve 90, and a pair of transparent films (not shown). The transparent film are welded to both sides of the frame 50, respectively. As a result, a chamber 100 that can store a liquid therein, such as ink, is formed inside a space enclosed by the frame 50 and the films. Note that the films are not depicted in FIG. 5.

The frame 50 substantially defines the exterior of the main body 20, and defines the six faces, i.e., the front face 41, the rear face 42, the top face 43, the bottom face 44, and the two side faces 45 of the main body 20. Therefore, the six faces of the main body 20 correspond to the six faces of the frame 50. Hereinafter, each face of the frame 50 is designated by reference numeral given to a respective one of the faces of the main body 20.

The frame 50 is formed of a transparent or semitransparent resin material, and is molded by, for example, injection molding by use of the resin material. Polyacetal, nylon, polyethylene, or polypropylene, or other similar materials, can be used as the resin material.

The frame 50 includes an outer wall 51 and a plurality of inner walls 52. The inner walls 52 are disposed inside the outer wall 51. The outer wall 51 and the inner walls 52 are integrally formed with each other. The outer wall 51 and the inner walls 52 are disposed across the width of the case from the left side face 45 to the right side face 45 of the main body 20. The outer wall 51 extends annularly along the front face 41, the top face 43, the rear face 42, and the bottom face 44 so as to create a space thereinside. As a result, openings 57 are formed in both side faces 45, respectively, of the frame 50.

A pair of thin films (not shown) formed of transparent resin are affixed to the side faces 45 of the frame 50, respectively. The films are welded to outer edge portions of the outer wall 51 on the side-face 45 sides, using an ultrasonic welding method. The openings 57 are closed with the films. Accordingly, a space enclosed by the outer wall 51 and the films are defined as a chamber 100. A liquid is stored in the chamber 100. Note that in this embodiment, the chamber 100 is formed by the frame 50 and the films. However, the frame 50 may also be formed like a rectangular-parallelepiped container so as to form a chamber 100 inside the frame 50.

The inner wall 52 is disposed in an area enclosed by the outer wall 51. The films are also welded to outer edge portions of the inner wall 52 on the side-face 45 sides. As a result, the films may be prevented from being flexed. Additionally, even if an external force is applied to the housing 22 toward the main body 20, the inner wall 52 may prevent the housing 22 from being deformed by the force. As a result, the main body 20 and the films may be prevented from being damaged.

An injection portion 150 is formed in the rear face 42 of the frame 50. The injection portion 150 is a substantially cylindrical hole bored from the rear face 42 toward the chamber 100. The injection portion 150 communicates with the chamber 100. The injection portion 150 is used to inject liquid into the chamber 100. The liquid flows into the chamber 100 through the injection portion 150. The injection portion 150 is integrally formed with the frame 50 near the lower end of the rear face 42. The liquid container 10 may be connectable to an external liquid source, such as an external liquid tank, in a state where the liquid container 10 is mounted to the storage device 276, which allows a continuous or intermittent liquid supply to the liquid container 10 from the external liquid source during the use of the liquid container 10. In this case, the housing 22 has an opening formed through the back wall 35 and includes a cover configured to selectively open and close the opening of the back wall 35. In order to supply liquid from the external liquid source to the liquid container 10, the cover of the housing 22 is separated from the opening of the back wall 35, and then a tube is inserted into the opening of the housing 22. Thereafter, an end of the tube is connected to the injection portion 150, and the other end of the tube is connected to the external liquid source.

Turning now to FIG. 6, a spring receiver 61 is formed on the rear face 42 of the frame 50. The spring receiver 61 is formed at a middle of the rear face 42 above the injection portion 150. The spring receiver 61 is a substantially cylindrical hole bored from the rear face 42 toward the chamber 100. The back portion of the spring receiver 61 on the side of the chamber 100 is closed, and hence the spring receiver 61 does not communicate with the chamber 100. An end of a coiled spring 23 (see, e.g., FIG. 4A) is stored in the spring receiver 61.

A projection 59 is provided on the top face 43 of the frame 50. Likewise, a projection 60 is provided on the bottom face 44 of the frame 50. The projection 59 vertically and upwardly protrudes from the top face 43 (i.e., upwardly in FIG. 5). The projection 60 vertically and downwardly protrudes from the bottom face 44 (i.e., downwardly in FIG. 5). The projections 59 and 60 are integrally formed with the frame 50 at substantially the middle in the depth direction i.e., in the direction of the arrow 33, of the frame 50 at a position closer to the front face 41 than to the rear face 42. When the main body 20 is inserted into the housing 22, the projections 59 and 60 are inserted into guide grooves 119 and 120 (see, e.g., FIGS. 4A and 4B) formed in the housing 22. A sliding mechanism of the main body 20 in the housing 22 is realized by the projections 59 and 60 and the guide grooves 119 and 120.

The projections 59 and 60 have inclined surfaces 63 and 64, respectively, formed on the side of the rear face 42. In each of the inclined surfaces 63 and 64, the height of the projection gradually decreases toward the rear-face 42 side, respectively. When the main body 20 is inserted into the housing 22, the inclined surfaces 63 and 64 enter the housing 22 while being in contact with the edge of the opening 110 (see, e.g., FIGS. 4A and 4B) of the housing 22. Accordingly, the main body 20 is smoothly guided into the housing 22. An upper wall 36 of the housing 22 is upwardly flexed or bent by the projection 59, whereas the lower wall 37 thereof is downwardly flexed or bent by the projection 60 until the projections 59 and 60 are inserted in the guide grooves 119 and 120 (see, e.g., FIGS. 4A and 4B), respectively. The upper wall 36 and the lower wall 37 return to their original positions when the projections 59 and 60 are inserted in the guide grooves 119 and 120, respectively. This structure prevents the main body 20 from being easily removed from the housing 22, once the projections 59 and 60 enter the guide grooves 119 and 120, respectively.

A detecting portion 140 is formed at the front face 41 of the frame 50. The detecting portion 140 is used to visually or optically detect the amount of ink stored in the ink chamber 100. The detecting portion 140 is integrally formed with the frame 50. Therefore, the detecting portion 140 is formed of a similar material as the frame 50, i.e., the detecting portion 140 is formed of a transparent or semitransparent resin material such that light, i.e., infrared light, can pass therethrough. The detecting portion 140 is irradiated with light, i.e., infrared light, emitted from a photosensor, such as a photo-interrupter, attached to the recording apparatus 250. The photosensor includes a light emitting element and a light receiving element. In this embodiment, light emitted from the light emitting element is projected onto a sidewall 140*b*, is then allowed to pass through the sidewall 140*b*, and may be received by the light receiving element (see, e.g., FIG. 5).

The detecting portion 140 protrudes from near the middle of the front face 41 of the main body 20 toward the outside of the main body 20. In other words, the detecting portion 140 is provided to protrude away from the ink chamber 100 (i.e., leftwardly in FIG. 5). The detecting portion 140 has five substantially-rectangular walls, and has an interior formed in a hollow, approximately box shape. In more detail, the detecting portion 140 has a rectangular front wall 140*a* that extends parallel to the front face 41 and is positioned a particular distance away from the front face 41, a pair of sidewalls 140*b*, an upper wall 140*c* connected to upper sides of the front wall 140*a* and the pair of the sidewalls 140*b*, and a lower wall 140*d* connected to lower sides of the front wall 140*a* and the pair of the side walls 140*b*. Note that the width of the front wall 140*a* i.e., dimension in a direction perpendicular to the paper of FIG. 5, is set to be smaller than the width of the front face 51 (see, e.g., FIG. 2).

As shown in FIG. 6, a space 142 enclosed by the front wall 140*a*, the sidewalls 140*b*, the upper wall 140*c*, and the lower wall 140*d* is formed in the detecting portion 140. There is no wall between the space 142 and the chamber 100, and hence the space 142 continuously leads to the chamber 100. An indicator portion 72 of the sensor arm 70 comes into and out of the space 142. In, FIG. 5 and FIG. 6, the indicator portion 72 has entered the space 142.

The sensor arm 70 is pivotable according to an amount of fluid stored in the chamber 100. As shown in FIG. 6, the indicator portion 72 that can come into and out of the space 142 is provided at one end of the sensor arm 70. A float portion 73 is provided at the other end of the sensor arm 70. The sensor arm 70 is pivotably supported by a rib 74 extending from the outer wall 51 at the center in the width direction of the outer wall 51. The float portion 73 has its interior formed in, for example, a hollow shape, and floats on a liquid by a buoyant force acting on the float portion 73. Therefore, the float portion 73 changes its position upwardly or downwardly based on an increase or a decrease in the amount of liquid in the chamber 100. Accordingly, the sensor arm 70 pivots according to the positional change of the float portion 73. The rib 74 is disposed on the outer wall 51 near a corner formed by the front face 41 and the bottom face 44. A supporting shaft 77 that pivotally supports the sensor arm 70 is formed on the rib 74, and the sensor arm 70 pivots about the supporting shaft 77.

If a sufficient amount of liquid is stored in the chamber 100, the sensor arm 70 is positioned such that the indicator portion 72 is in the space 142 (see FIG. 6). More specifically, the indicator portion 72 is in the detecting portion 140, and contacts the lower wall 140*d*. On the other hand, if the amount of liquid stored therein becomes insufficient, the float portion 73 moves down, and, as a result, the indicator portion 72 moves up and moves out of the space 142. Since the sensor arm 70 operates in this manner, whether the amount of ink stored in the chamber 100 is sufficient can be detected by monitoring the presence or absence of the indicator portion 72 in the space 142 by use of a photosensor, such as a photo interrupter, from the outside of the detecting portion 140.

As shown in FIG. 6, a circular opening 82 is provided at the upper portion of the front face 41 of the frame 50, i.e., above the detecting portion 140. A cylindrical valve storing chamber 55 is formed inside the frame 50 and connected to the opening 82. The valve storing chamber 55 extends in a depth direction of the main body 20 i.e., in the direction of the double-arrow 33 toward the rear of the main body 20. The valve storing chamber 55 communicates with the chamber 100 at its deeper side. The atmospheric introduction valve 80 is stored in the valve storing chamber 55.

The atmospheric introduction valve 80 serves as a valve operating mechanism that opens or closes a path leading from the opening 82 to an air layer of the chamber 100. The atmospheric introduction valve 80 includes a valve body 87, a spring 86, a seal member 83, and a cap 85. The valve body 87 is disposed so as to be slidable in the depth direction of the main body 20 in the valve storing chamber 55. The valve body 87 has a lid 88 and a rod 84. The rod 84 is inserted into an atmospheric introduction opening 81 described later. The rod 84 is formed to be smaller in diameter than the atmospheric introduction opening 81. Therefore, a gap through which air flows is created between the rod 84 and the atmospheric introduction opening 81. The rod 84 outwardly protrudes from the center of the lid 88 through the center of the opening 82. When the liquid container 10 is mounted to the storage device 276, the rod 84 is operated to open the atmospheric introduction valve 80 before the ink supply valve 90 is opened.

When the valve body 87 is slid in the valve storing chamber 55, the lid 88 is slid between a position contacting the seal member 83 and a position spaced from the seal member 83 in accordance with the sliding of the valve body 87. When the lid 88 contacts the seal member 83, the atmospheric introduction opening 81 is closed. In other words, the path leading from the valve storing chamber 55 to the outside through the gap is closed. On the other hand, when the lid 88 moves to away from the seal member 83, the atmospheric introduction opening 81 is opened. That is, the path leading from the valve storing chamber 55 to the outside through the gap is opened.

The cap 85 is attached to the outer edge of the opening 82 sandwiching the seal member 83 therebetween. A through-hole (not shown) is provided in the cap 85 and the seal member 83. When the cap 85 and the seal member 83 are attached to the outer edge of the opening 82, the through-hole forms the atmospheric introduction opening 81 to allow the fluid communication between the inside and the outside of the valve storing chamber 55.

In the valve storing chamber 55, the spring 86 urges the valve body 87 in a direction in which the path leading from the opening 82 to the chamber 100 is closed. In other words, the spring 86 presses the valve body 87 in a direction in which the lid 88 is brought close to the seal member 83. Therefore, normally, the atmospheric introduction valve 80 closes the atmospheric introduction opening 81 with the lid 88. On the other hand, when the rod 84 is pressed toward a deeper side of the opening 82 i.e., pressed into the main body 20, the lid 88 of the valve body 87 moves to be separated from the seal member 83 against an urging force of the spring 86, and the atmospheric introduction opening 81 is opened. As a result, the path leading from the opening 82 to the chamber 100 is opened. Air flows into or out of the chamber 100 through the atmospheric introduction opening 81, and hence an air layer created in the chamber 100 becomes substantially equal in pressure to the atmospheric pressure.

As shown in FIG. 6, a circular opening 92 is provided at the lower portion of the front face 42 of the frame 50, i.e., below the detecting portion 140. A cylindrical valve storing chamber 54 is formed inside the frame 50 and connected to the opening 92. The valve storing chamber 54 extends in the depth direction of the main body 20. The valve storing chamber 54 communicates with the chamber 100 at its deeper side. A liquid supply valve 90 is stored in the valve storing chamber 54.

The liquid supply valve 90 serves as a valve operating mechanism that opens or closes the path leading from the opening 92 to the chamber 100. The liquid supply valve 90 includes a valve body 97, a spring 96, a seal member 93, and a cap 95.

The cap 95 is attached to the outer edge of the opening 92 sandwiching the seal member 93 therebetween. A through-hole (not shown) is provided in the cap 95 and the seal member 93. When the cap 95 and the seal member 93 are attached to the outer edge of the opening 92, the through hole forms a liquid supply opening 91 to allow the fluid communication between the inside and the outside of the valve storing chamber 54. When the liquid container 10M is mounted to the storage device 276 (see, e.g., FIG. 7), a liquid extraction portion, e.g., a tubular push rod 275 is inserted into the liquid supply opening 91.

In the valve storing chamber 54, the spring 96 urges the valve body 97 in a direction in which the above-mentioned ink path is closed. In other words, the spring 96 urges the valve body 97 in a direction approaching the seal member 93. Therefore, normally, the liquid supply valve 90 closes the liquid supply opening 91 with the valve body 97. On the other hand, when the push rod 275 is inserted into the liquid supply opening 91, the valve body 97 is pushed by the push rod 275 and moves to be separated from the seal member 93 against an urging force of the spring 96, and the liquid supply opening 91 is opened. As a result, liquid stored in the chamber 100 can be guided toward the recording head 272 of the recording apparatus 250 through the push rod 275.

Next, a structure of the housing 22 will be described in detail. As shown in FIG. 2 and FIGS. 4A and 4B, the housing 22 has a container shape to cover the rear portion 20*b* of the main body 20. The housing 22 is formed in a flat shape corresponding to the external shape of the rear portion 20*b*. In more detail, the housing 22 includes a back wall 35 corresponding to the rear face 42 of the main body 20, an upper wall 36 corresponding to the top face 43, a lower wall 37 corresponding to the bottom face 44, and a left sidewall 38 and a right sidewall 39 corresponding to both side faces 45 of the main body 22, respectively. The space enclosed by these walls is a storing space in which the rear portion 20*b* is covered.

As shown in FIGS. 4A and 4B, the housing 22 has an opening 110 that allows the main body 20 to be inserted therein. The rear portion 20*b* is inserted into the housing 22 from the opening 110. As a result, the rear portion 20*b* is covered with the housing 22.

The guide groove 119 is formed in the inner surface of the upper wall 36 of the housing 22. Likewise, the guide groove 120 is formed in the inner surface of the lower wall 37. The guide grooves 119 and 120 extends along the depth direction of the housing 22 i.e., along the direction of the double-sided arrow 33. As described above, when the main body 20 is inserted into the housing 22, the projections 59 and 60 are inserted into the guide grooves 119 and 120, respectively. As a result, the sliding direction of the main body 20 coincides with the depth direction of the housing 22.

A spring seat 114 is provided on the inner surface of the back wall 35. The spring seat 114 is provided at a position corresponding to the spring receiver 61. The spring seat 114 is formed in, for example, a cylindrical shape, and protrudes inwardly. The outer diameter of the spring seat 114 is designed to be fitted to an inner hole of the coiled spring 23. One end of the coiled spring 23 is supported by the spring seat 114 by fitting the inner hole of the coiled spring 23 to the spring seat 114.

A guide groove 116 is formed in the outer surface of the upper wall 36. Likewise, a guide groove 117 is formed in the outer surface of the lower wall 37. Each of the guide grooves 116 and 117 extends along the depth direction of the housing 22, i.e., along the direction of the double-sided arrow 33 from one end positioned at the opening 110 side to the other end positioned at the back-wall 35 side. The one end of the guide groove 116 is opened toward the insertion direction 30 when the liquid container in the standing position. The one end of the guide groove 117 is opened similarly. When a liquid container, such as the liquid container 10M, is inserted into the case 280M (see, e.g., FIG. 7), a rail (not shown) provided on the side of the top face of the case 280M is inserted into the guide groove 116. A projection 132 upwardly protruding from the lower face of the case 280M is also inserted into the guide groove 117 (see, e.g., FIGS. 10 and 11). As a result, in the case 280M, the liquid container 10M is smoothly guided in the insertion direction 30.

As shown in FIGS. 4A and 4B, the guide groove 117 extends from the one end to the other end that is terminated by a restricting portion, e.g., a wall 118. Therefore, when a liquid container, such as the liquid container 10M, is inserted into the case 280M, the projection 132 inserted into the guide groove 117 from the one end of the guide groove 117 contacts the wall 118 at a particular position. As a result, further insertion of the housing 22 in the insertion direction 30 is restricted by the projection 132 contacting the wall 118.

Figure 3B:
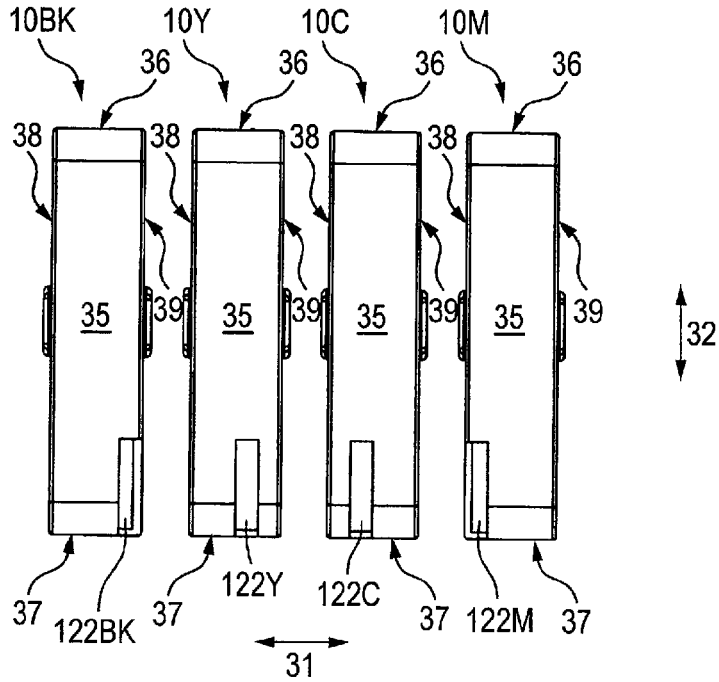

As shown in FIG. 2 and FIGS. 3A and 3B, the housing 22 of each liquid container has a slit 122. The slit 122 is provided in a corner formed by the back wall 35 and the lower wall 37. A projection member 245 provided on a lock lever 283 (see FIG. 7) described later is inserted into the slit 122. In other words, the slit 122 included in the housing 22 provides a keying feature for the liquid container.

As shown in FIGS. 3A and 3B, the slit 122 is provided in each of the liquid containers 10BK, 10Y, 10C, and 10M. The slit 122 is formed by cutting the corner formed by the back wall 35 and the lower wall 37 toward the inside of the housing 22. Hereinafter, the slit 122 of the liquid container 10BK, the slit 122 of the liquid container 10Y, the slit 122 of the liquid container 10C, and the slit 122 of the liquid container 10M are designated as 122BK, 122Y, 122C, and 122M, respectively. Each slit 122 has the same size in width and length.

As shown in FIGS. 3A and 3B, the slits 122BK, 122Y, 122C, and 122M differ from each other in a position in the width direction, i.e. direction of the arrow 31 of the housing 22. For example, the slit 122BK is disposed adjacent to the right sidewall 39 when viewed from the back wall 35 of the housing 22. The slit 122Y is disposed at substantially the center of the housing 22 in the width direction, but at a position slightly closer to the right sidewall 39 than to the left sidewall 38. The slit 122C is disposed at substantially the center of the housing 22 in the width direction, but at a position slightly closer to the left sidewall 38 than to the right sidewall 39. The slit 122M is disposed adjacent to the left sidewall 38. Thus, the relative position of the slits 122BK, 122Y, 122C, and 122M may be used as a keying feature to uniquely distinguish one of the liquid containers from the other liquid containers.

The coiled spring 23 and the main body 20 are attached to the housing 22 as described above, thereby forming the liquid container 10M. In more detail, first, the coiled spring 23 is attached to the spring seat 114. Thereafter, the main body 20 is positioned to coincide in the longitudinal direction with the housing 22, and then the rear portion 20*b* of the main body 20 is inserted into the housing 22 through in the opening 110. When the rear portion 20*b* is inserted in the housing 22, one end of the coiled spring 23 is inserted into the spring receiver 61. As a result, the coiled spring 23 is disposed so as to expand and contract in the insertion direction 30. When the rear portion 20*b* is further inserted against an urging force of the coiled spring 23, the projections 59 and 60 of the main body 20 are inserted into the guide grooves 119 and 120, respectively. The coiled spring 23 acts as a so-called helical compression spring. Therefore, the coiled spring 23 always exerts its urging force in a direction in which the main body 20 moves out from the housing 22. The liquid container 10M is assembled in this way, in which the main body 20 is slidable in the housing 22.

A main structure of the storage device for storing liquid containers will be hereinafter described with reference to FIG. 7 to FIG. 10.

Figure 7:
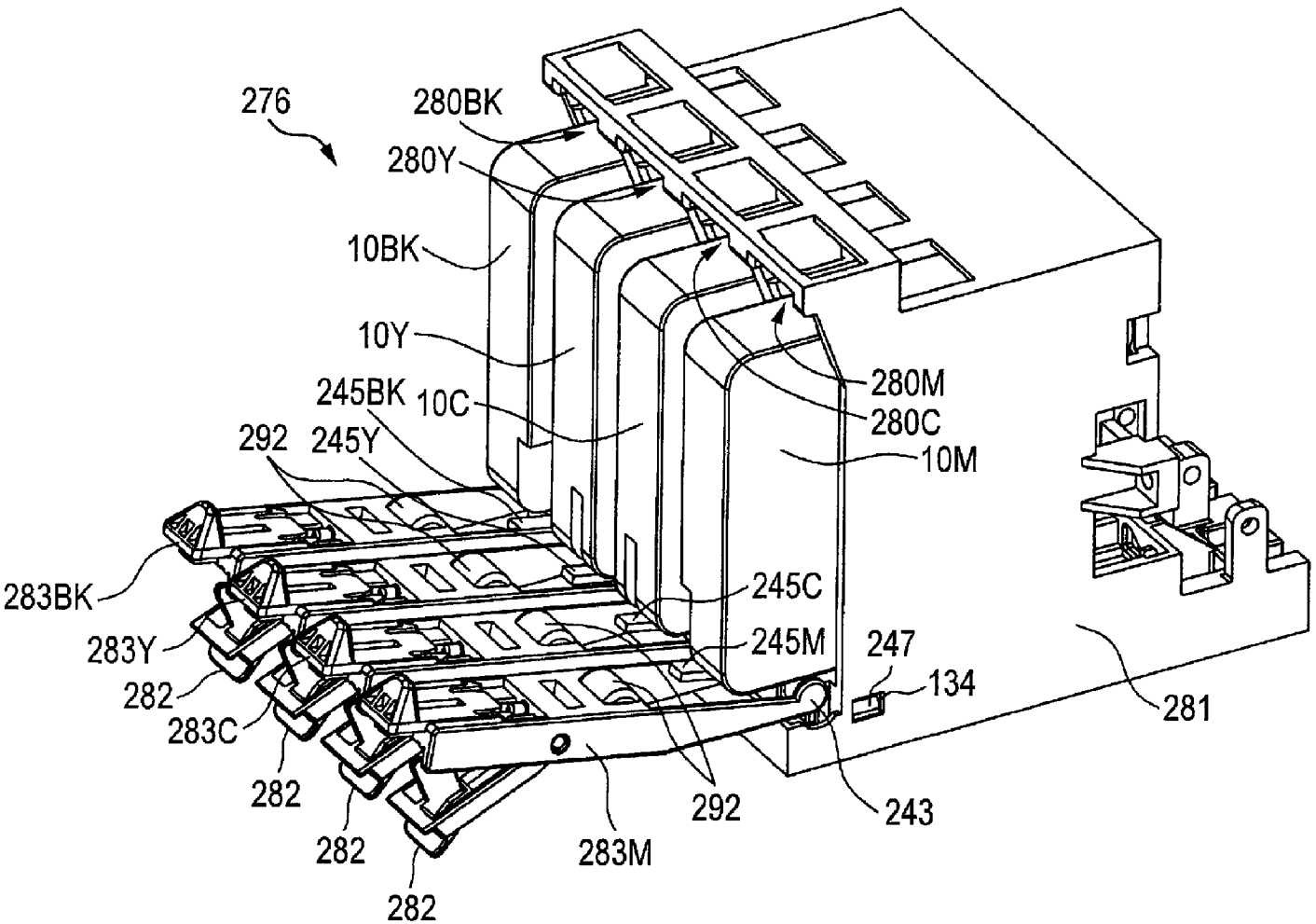
FIG. 7 is a perspective view of a storage device for storing liquid containers according to an embodiment of the present invention.

As shown in FIG. 7, a storage device 276 comprises a case body 281 and four cases 280BK, 280Y, 280C, and 280M corresponding to four liquid containers 10BK, 10Y, 10C, and 10M, respectively. Thus, the four liquid containers 10BK, 10Y, 10C, and 10M can be mounted to corresponding ones of the four cases 280BK, 280Y, 280C, and 280M at a mounted position. Each liquid container 10BK, 10Y, 10C, and 10M is pre-assigned to a corresponding one of the cases 280BK, 280Y, 280C, and 280M. In other words, each case 280BK, 280Y, 280C, and 280M is pre-assigned to a corresponding one of the liquid containers 10BK, 10Y, 10C, and 10M. In this embodiment, each liquid container 10BK, 10Y, 10C, and 10M is assigned to a corresponding one of the cases 280BK, 280Y, 280C, and 280M in accordance with a color of ink stored in each of the liquid containers. For example, black ink, yellow ink, cyan ink, and magenta ink are stored in the four liquid containers 10BK, 10Y, 10C, and 10M, respectively.

However, one of ordinary skill in the art will appreciate that the liquid containers may be assigned to the respective cases for any reason, for example they may be assigned based on a feature or property of the liquid, or based on a frequency of use of the liquid, etc. Each color ink stored in each liquid container 10BK, 10Y, 10C, and 10M is supplied to the recording head 272 through a respective tube 278 (see FIG. 1).

A lock lever 283 is provided on the front side of the case 280. A lock lever 283 is provided for each case 280BK, 280Y, 280C, and 280M. Hereinafter, the lock lever 283 for the case 280BK, the lock lever 283 for the case 280Y, the lock lever 283 for the case 280C, and the lock lever 283 for the case 280M are designated as the lock levers 283BK, 283Y, 283C, and 283M, respectively. The lock lever 283 is used to operate a lock mechanism 130 described later. The lock lever 283 is also used as a door which opens and closes with respect to the opening 279 of the case 280.

Figure 8A:
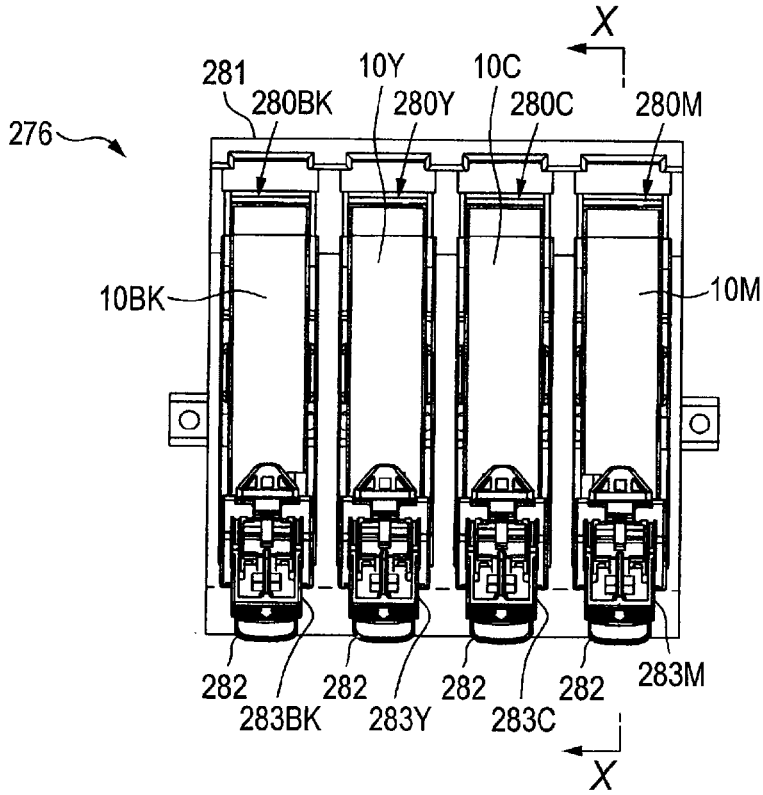
FIGS. 8A and 8B are front and side views, respectively, of the storage device of FIG. 7 in which a lock lever is opened.
Figure 8B:
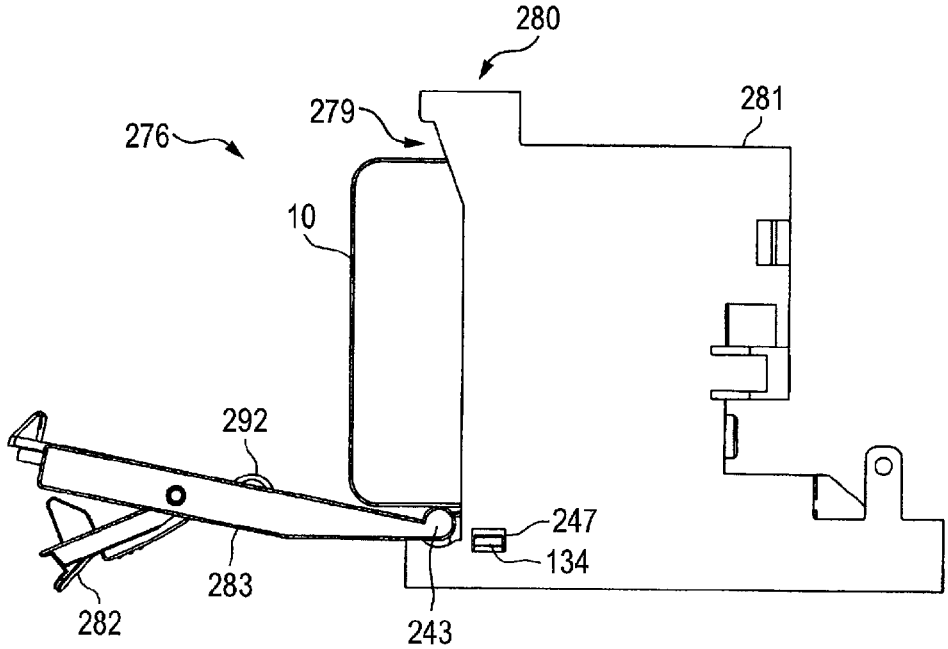
Figure 9A:
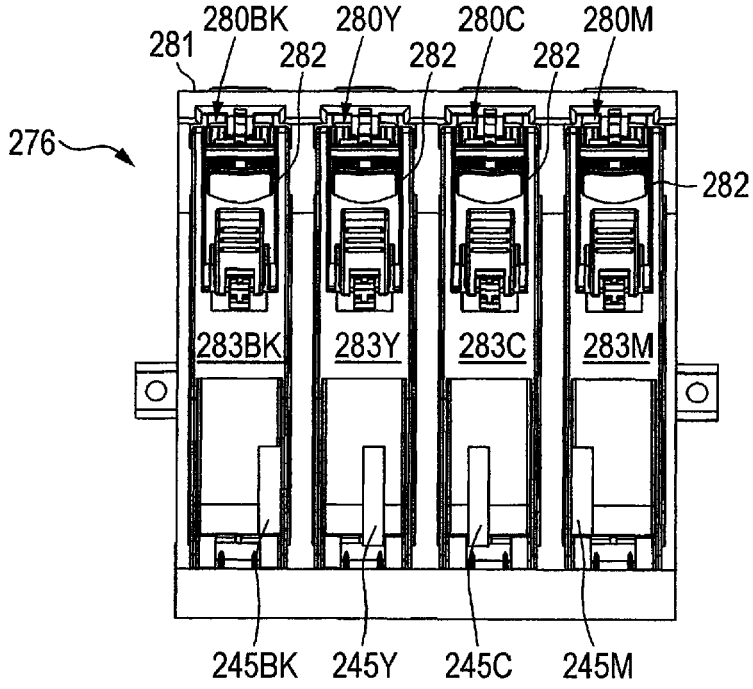
FIGS. 9A and 9B are front and side views, respectively, of the storage device of FIG. 7 in which the lock lever is closed.
Figure 9B:
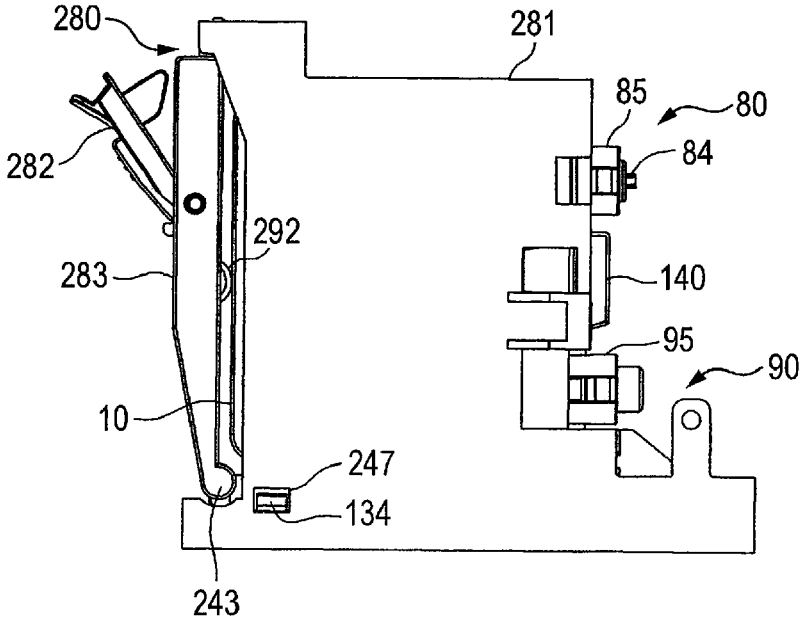

A shaft 244 (see FIG. 10) is provided at the lower portion of the storage case 276. A connecting portion 243 rotatably supported by the shaft 244 is provided at the lower end of the lock lever 283. The lock lever 283 is rotatable upon the shaft 244 between a first position and a second position, because the connecting portion 243 is supported by the shaft 244. Thereby, the lock lever 283 is opened and closed with respect to the opening 279 of the case 280. In FIG. 7 and FIGS. 8A and 8B the lock lever 283 is positioned in the first position, i.e., the lock lever 283 is opened with respect to the opening 279. In FIGS. 9A and 9B the lock lever 283 is in the second position, i.e., the lock lever 283 is closed with respect to the opening 279.

A link member 242 is provided at the connecting portion 243. The link member 242 is integrally formed with the connecting portion 243. When the lock lever 283 is rotated, the link member 242 is rotated in the same direction as the lock lever 283. The link member 242 downwardly presses a rib 144 described later in accordance with the rotational of the lock lever 283.

When the lock lever 283 is opened, the interior of the case 280 is exposed to the outside through the opening 279 (see FIG. 8B) formed in the front face of the case 280. The liquid container 10 is inserted to the case 280 through the opening 279. On the other hand the lock lever 283 is locked with respect to the case 280 in the second position. A release lever 282 is provided at the upper end of the lock lever 283. The lock lever 283 can be unlocked by operating the release lever 282.

A pressing member 292 is provided on the inner surface of the lock lever 283. The pressing member 292 protrudes from the inner surface of the lock lever 283 in a direction perpendicular to the inner surface of the lock lever 283. When the lock lever 283 is closed, the pressing member 292 is brought into contact with a surface of the back wall 35 of the housing 20, and presses the liquid container 10 toward the deeper side of the case 280. As a result, the liquid container 10 is reliably mounted in the case 280 at the mounted position.

As shown in FIGS. 3B, 9A, and 9B, the lock lever 283 has a projection member 245. The projection member 245 protrudes from adjacent to the lower end of the lock lever 283 toward the liquid container when the lock lever 283 is closed. A projection member 245 is provided on each of the lock levers 283BK, 283Y, 283C, and 283M. Hereinafter, the projection member 245 of the lock lever 283BK, the projection member 245 of the lock lever 283Y, the projection member 245 of the lock lever 283C, and the projection member 245 of the lock lever 283M are designated as the projection members 245BK, 245Y, 245C, and 245M, respectively.

These projection members 245 differ from each other in position in the width direction of the lock lever 283. As shown in FIGS. 3B, 9A, and 9B, the projection member 245BK is disposed at the right side end of the lock lever 283BK when viewed in the insertion direction 30. The projection member 245Y is disposed at substantially the center of the lock lever 283Y in the width direction, but at a position slightly closer to the right side end of the lock lever 283Y to the left side end of the lock lever 283Y. The projection member 245C is disposed at substantially the center of the lock lever 283C in the width direction, but at a position slightly closer to the left side end of the lock lever 283C than to the right side end of the lock lever 283C. The projection member 245M is disposed at the left side end of the lock lever 283M. These projection members 245BK, 245Y, 245C, and 245M are positioned corresponding to the slits 122BK, 122Y, 122C, and 122M formed in the housings 22 of the liquid containers 10BK, 10Y, 10C, and 10M, respectively. More specifically, when the liquid container 10M is mounted in the case 280M, the projection member 245M is positioned so as to be inserted into the slit 122M in accordance with the rotation of the lock lever 283M. Likewise, the projection members 245BK, 245Y, and 245C are positioned so as to be inserted into the slits 122BK, 122Y, and 122C, respectively.

Figure 10:
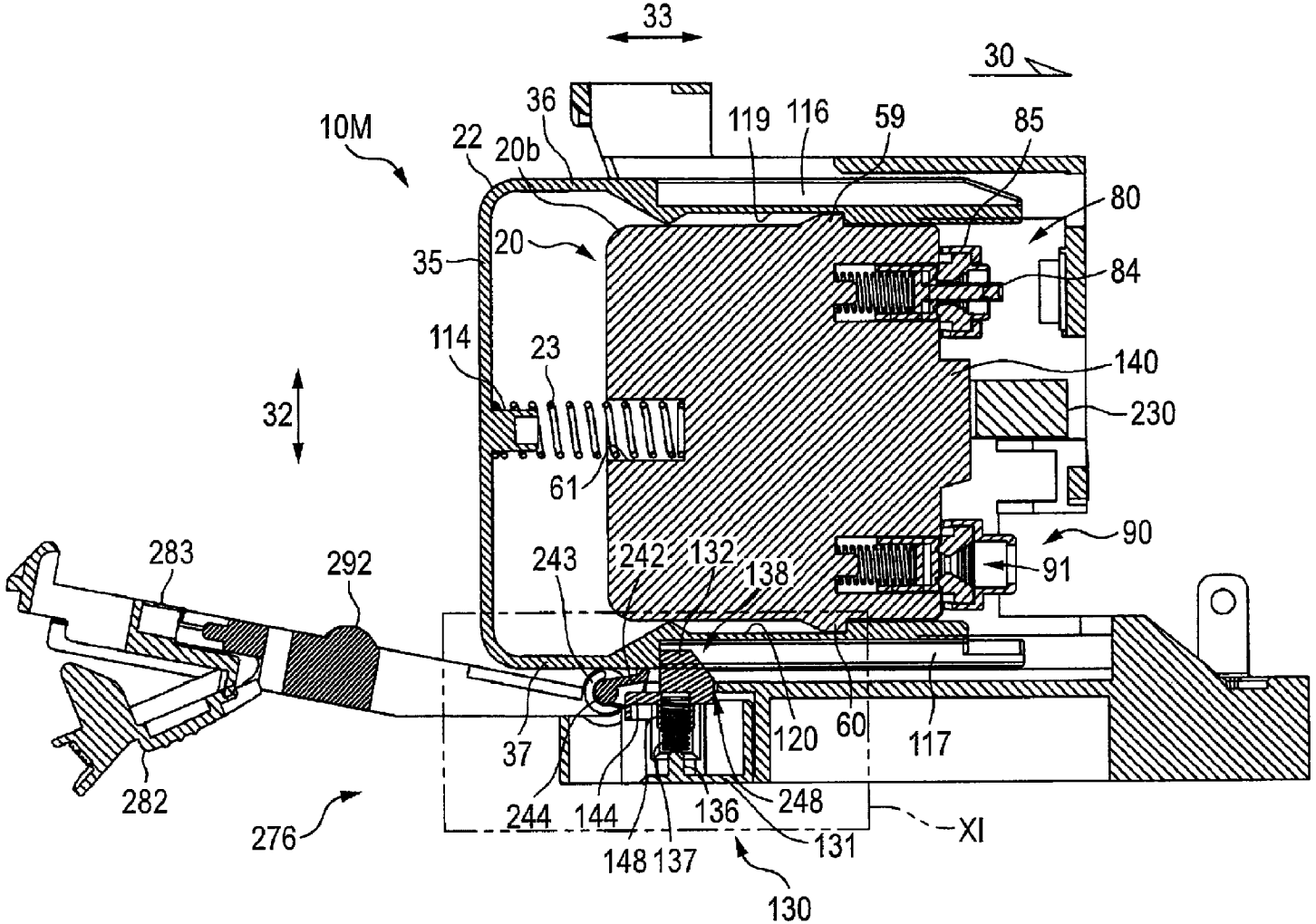
FIG. 10 is a cross-sectional view along a line X-X of FIG. 8(*a*)

As shown in FIG. 10, a photosensor 230 is provided at the deeper side of the case 280. A photosensor 230 is provided for each case 280. A transmission type photo interrupter that has a light emitting element and a light receiving element is used as the photosensor 230. There is a space, into which and from which the detecting portion 140 of the liquid container 10 can be inserted and removed, between the light emitting element and the light receiving element. The photosensor 230 is connected to a controller (not shown) to which an electric signal output from the light receiving element is output as an output signal. The space between the light emitting element and the light receiving element is an area in which an optical path of light, e.g., infrared light, emitted from the light emitting element exists. In this embodiment, whether the residual amount of liquid in the chamber 100 is sufficient is detected based on the output signal i.e., the intensity of light received, of the photosensor 230 obtained when the detecting portion 140 is inserted into the area.

The push rod 275 is provided in the deeper side of the case 280. The push rod 275 is provided for each case 280. The push rod 275 is a hollow tube that protrudes from the deeper side face toward the front face of the case 280. In the process of inserting the liquid container 10 into the case 280, the push rod 275 is inserted into the liquid supply opening 91 of the liquid supply valve 90 of the liquid container 10. In other words, the push rod 275 is positioned to correspond to the liquid supply valve 90 of the liquid container 10 when the liquid container 10 is mounted to the storage device 276.

As shown in FIG. 10, the lock mechanism 130 is provided under the lower face of the case 280. A lock mechanism 130 is provided for each case 280. The lock mechanism 130 restricts the movement of the liquid container 10 in the insertion direction 30 in the case 280. In response to the position of the lock lever 283, the lock mechanism 130 selectively restricts and allows the movement of the liquid container 10 in the insertion direction 30.

Figure 11:
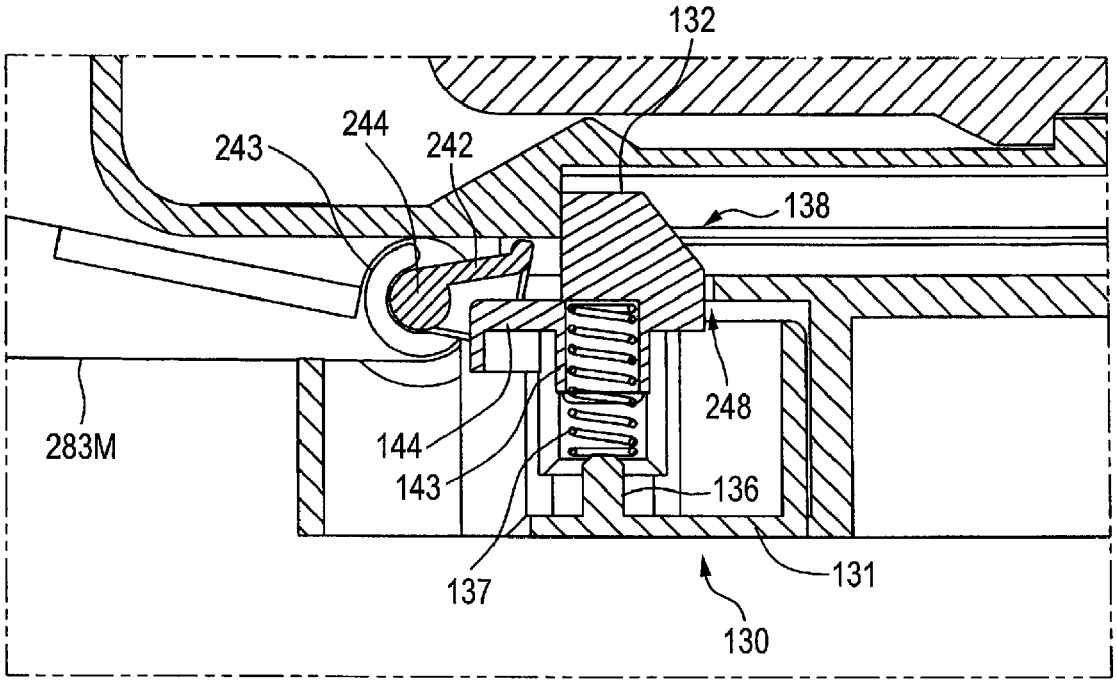
FIG. 11 is a partially enlarged view of a main portion XI, which is enclosed by an alternate long and two short dashed line, of FIG. 10.
Figure 12:
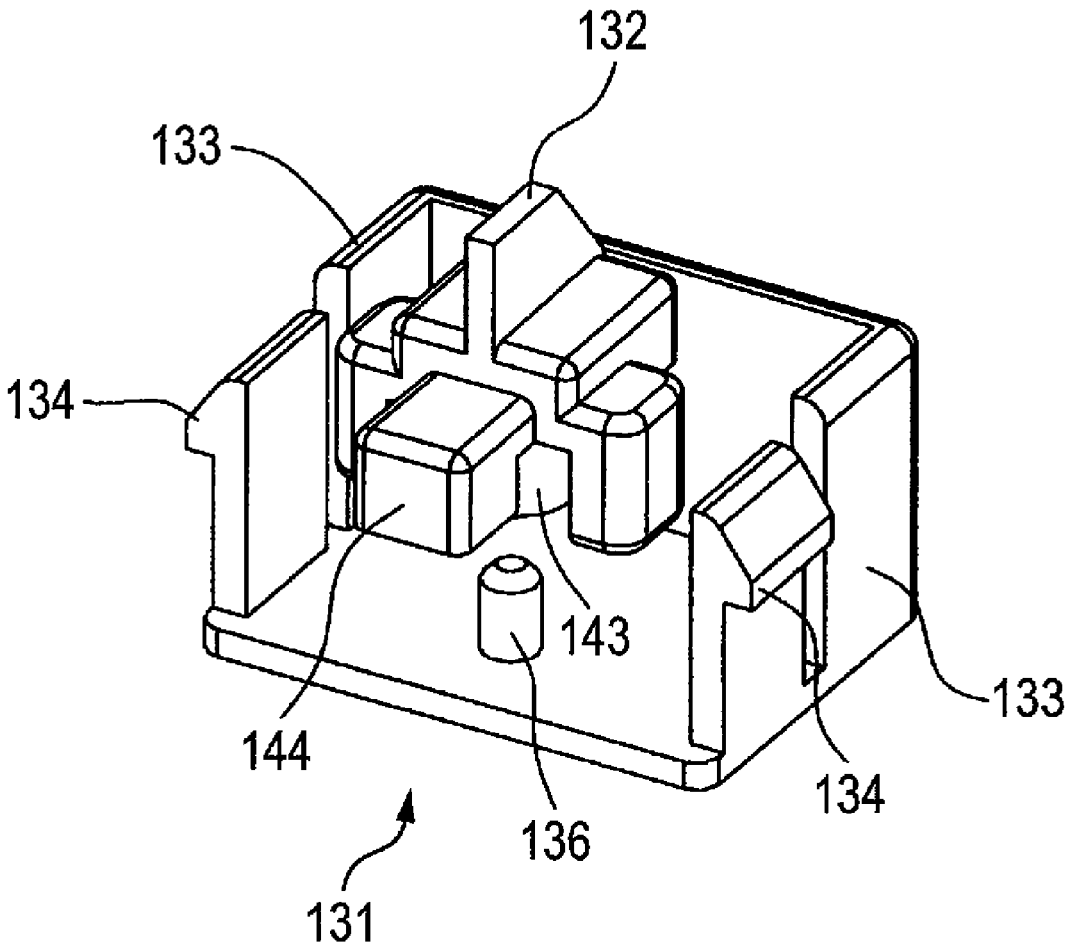
FIG. 12 is a perspective view of a base of a lock mechanism according to an embodiment of the present invention.

The structure of the lock mechanism 130 will be hereinafter described with reference to FIG. 11 and FIG. 12. Note that a coiled spring 137 is omitted in FIG. 12.

The lock mechanism 130 includes a base 131, an elastic member, e.g., a coiled spring 137, and a slider 138. As shown in FIG. 12, the base 131 has a container shape whose top face is opened. The base 131 has sidewalls 133 facing each other, and hook-shaped engagement members 134 are provided on sidewalls 133, respectively. The engagement members 134 are inserted from the inside of the case 280 into cutouts 247 (see FIG. 7) formed through side faces of the case 280, respectively, and thereby the lock mechanism 130 is fixed to the case 280.

A spring seat 136 is provided on the base 131. The spring seat 136 includes a cylindrical member protruding from the bottom face of the base 131. An inner hole of the coiled spring 137 is inserted into the spring seat 136, and thereby the lower end of the coiled spring 137 is supported.

The slider 138 is disposed above the spring seat 136 so as to be slidable in upward and downward directions. The slider 138 includes a projection 132 disposed at its upper portion, a spring receiver 143 disposed at its lower portion, and a rib 144 horizontally protruding. The link member 242 is disposed above the rib 144. The spring receiver 143 is formed in a cylindrical shape. The upper end of the coiled spring 137 is stored in the cylindrical body of the spring receiver 143. In this manner, the slider 138 is elastically supported by the coiled spring 137.

The projection 132 is formed of a plate member protruding upwardly from the upper portion of the slider 138. The projection 132 is has a length in the insertion direction 30, and a width perpendicular to the length. The length of the projection 132 is greater than the width of the projection 132. An opening 248 is formed through the lower face of the case 280 at a position corresponding to the projection 132. When the slider 138 slides upwardly and downwardly, the projection 132 moves between protruding position in which the projection 132 protrudes via the opening 248 into the case 280 and a retracted position in which the projection 132 is retracted from the case 280. In other words, when the projection 132 is positioned in the protruding position, the projection 132 protrudes into an insertion path formed in the case 280 along which the liquid container 10 is inserted from the opening 279 to the mounted position, and when the projection 132 is positioned in the retracted position, the projection 132 is retracted from the insertion path. In FIG. 10 and FIG. 11, the projection 132 is in the protruding position.

Referring to FIGS. 13A to 13D, a description will be hereinafter given of the operation of the lock mechanism 130 performed when the liquid container 10M corresponding to the case 280M is mounted to the case 280M.

When the lock lever 283M is in the first position in which the lock lever 283 is laid down (see FIG. 13A), the projection 132 protrudes into the case 280M and into the insertion path. When the liquid container 10M is inserted into the case 280M from the opening 279 along the insertion path, the projection 132 is inserted into the guide groove 117 formed in the lower wall 37 of the housing 22. When the liquid container 10M is further inserted in the insertion direction 30, the projection 132 is brought into contact with the wall 118 of the guide groove 117. As a result, the insertion of the liquid container 10M into the case 280M in the insertion direction 30 is restricted before the liquid container 10M is inserted to the mounted position and before the valve body 97 is pushed by the push rod 275.

Figure 13A:
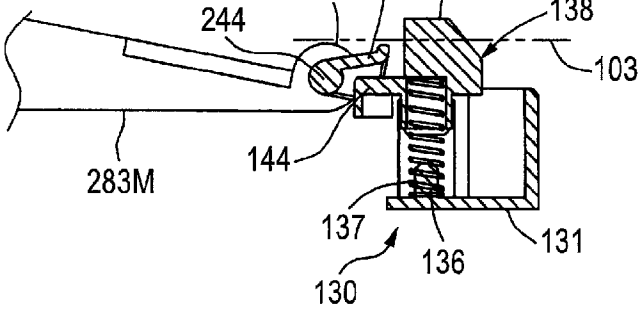
FIGS. 13A to 13D are partial sectional views of the lock mechanism according to an embodiment of the present invention, in which the lock lever is laid down in FIG. 13A, a link member contacts a top face of a rib in FIG. 13B, a projection is retracted from an inside of a case in FIG. 13C, and the lever is closed to cover an opening of a case in FIG. 13D.
Figure 13B:
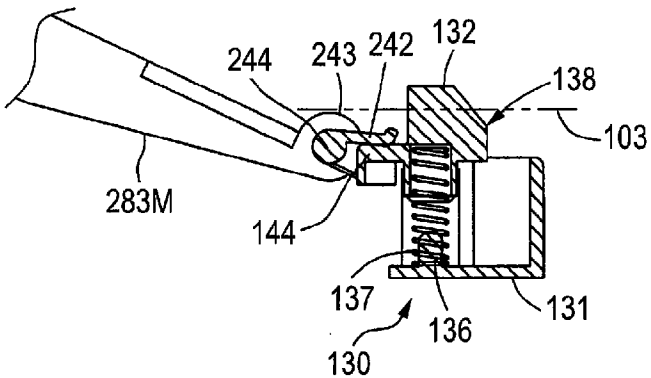

Thereafter, when the lock lever 283M is rotated clockwise (from the position of FIG. 13A toward the position of FIG. 13D), the link member 242 is brought into contact with the rib 144 (see FIG. 13B). When the lock lever 283M is further rotated in the same direction, the projection member 245M of the lock lever 283M is inserted into the slit 122M of the housing 22. As a result, the lock lever 283M is allowed to be rotated clockwise.

Figure 13C:
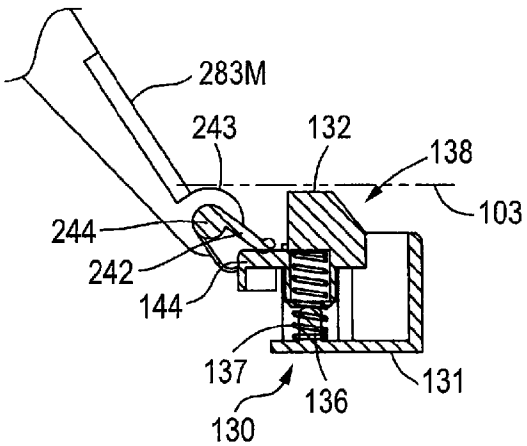
Figure 13D:
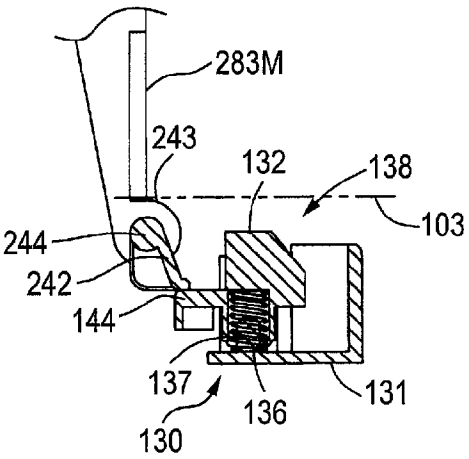

When the lock lever 283M is further rotated from the position of FIG. 13B, the link member 242 downwardly presses the rib 144. As a result, the slider 138 moves downwardly against an urging force of the coiled spring 137. Accordingly, the coiled spring 137 is compressed, and the projection 132 is downwardly moved. Thereby, as shown in FIG. 13C, the projection 132 is retracted from the case 280M. The position of the lock lever 283M of FIG. 13C corresponds to a third position. The projection 132 is retracted from the case 280M, and, as a result, the engagement between the projection 132 and the wall 118 is released. Thereby, the liquid container 10M can move forward in the insertion direction 30.

When the lock lever 283M is rotated to the second position in which the lock lever 283 is closed such that the opening 279M of the case 280M is covered by the lock lever 283 (see FIG. 13D), the liquid container 10M is inserted into the deeper side of the case 280M while the back of the liquid container 10M is being pressed by the lock lever 283M. As a result, the liquid container 10M is mounted in the case 280M at the mounted position.

Even when the liquid container 10C that is not pre-assigned to the case 280M is inserted into the case 280M when the lock lever 283M is in the first position in which the lock lever 283 is laid down (see FIG. 13A), the liquid container 10C is inserted into the case 280M until the projection 132 comes into contact with the wall 118 of the guide groove 117. However, since the projection member 245M does not positionally coincide with the slit 122C of the liquid container 10C, the projection member 245M is not inserted in the slit 122C of the liquid container 10C. Therefore, the projection member 245M is brought into contact with the housing 22, and the rotation of the lock lever 283M is restricted and cannot be rotated any further. Therefore, the projection 132 cannot be retracted from the case 280M.

In this embodiment, the lock mechanism 130 is provided as described above, and hence, if a wrong liquid container 10 is inserted into the case 280, the insertion of liquid container 10 is restricted before the liquid container 10 is mounted to the case 280 completely. Moreover, if the correct liquid container 10 is inserted into the case 280, the insertion of the liquid container 10 is temporarily stopped by the projection 132 at a particular position. Thereafter, the lock lever 283 is rotated, and thereby the liquid container 10 can be mounted in the case 280 completely. Since the insertion of the liquid container 10 is temporarily stopped, the liquid container 10 can be prevented from being forcibly inserted, and therefore the liquid container 10, the case 280, etc., can be prevented from being damaged.

In the above-mentioned embodiment, the housing 22 is provided with the slit 122, and the lock lever 283 is provided with the projection member 245. However, according to another embodiment, the housing 22 may be provided with the projection member 245, and the lock lever 283 may be provided with the slit 122. Further, a recess may be formed on the housing 22 or the lock lever 283 instead of the slit 122.

According to the above embodiments of the invention, if the liquid container is inserted from the insertion opening into a case that is pre-assigned to mount the liquid container when the lever is in the first position, the liquid container is stopped by the first member at a particular position in the insertion path in order to prevent the liquid container from being further inserted. The position of the lever can be changed by the second member from the first position to the third position. When the lever moves from the first position to the third position, the first member is moved by the link member from a protruding position to the retracted position. As a result, the liquid container can be further inserted into the deeper side from the particular position. When the lever moves to the second position, the liquid container is pressed toward the deeper side of the case and mounted to the case.

On the other hand, if a liquid container is inserted from the insertion opening into a wrong case when the lever is in the first position, the liquid container is stopped by the first member at a particular position in the insertion path so as not to be inserted further. However, in this example, a positional change of the lever from the first position to the third position is restricted by the second member. Therefore, the first member remains in the protruding position. Therefore, the liquid container is restricted in insertion from the particular position toward the deeper side. As a result, the liquid container is prevented from being erroneously inserted into a wrong case.

Further, when the first member is in the protruding position, the first member prevents the liquid container to be inserted before connecting the ink supply portion of the liquid container to the ink introduction path provided in the storage device. Therefore, even when the liquid container is erroneously inserted into a wrong case, a liquid stored in the liquid container does not leak.

Moreover, the second elastic member is interposed between the main body and the housing in the liquid container. Accordingly, the liquid container is reliably retained in the case in which the main body is pressed by a constant force of the second elastic member in the insertion direction when the lock lever is in the second position. Further, when the lever returns from the second position to the third position, the second elastic member expands, and hence the liquid container is ejected out from the case with the force of the second elastic member.

What is claimed is:

1. A storage device for storing a first liquid container and a second liquid container, the storage device comprising:

a first case and a second case configured to receive the first liquid container and the second liquid container therein at a first and second mounted position, respectively, wherein each of the first case and the second case has an insertion opening and an insertion path formed therein to allow the corresponding one of the first and second liquid containers to be inserted from the corresponding insertion opening in an insertion direction to the first or second mounted position through the corresponding insertion path;

a first lever and a second lever attached to the first case and the second case, respectively, wherein each of the first lever and the second lever is configured to move between:

a first position in which the lever is separated from the corresponding insertion opening, such that the corresponding one of the first and second liquid containers is allowed to be inserted into the corresponding one of the first and second cases from the corresponding insertion opening, a second position in which the corresponding one of the first and second liquid containers having been inserted into the corresponding one of the first and second cases is pressed by the corresponding one of first and second levers, such that the corresponding one of the first and second liquid containers is positioned in the first or second mounted position, respectively, and a third position between the first position and the second position, wherein each of the first and second levers moves from the first position to the second position when that lever moves toward the insertion opening;

a first protruding member and a second protruding member provided at the first case and the second case, respectively, wherein each of the first protruding member and the second protruding member is configured to move between a protruding position in which that protruding member protrudes into the corresponding insertion path formed in the corresponding one of the first and second cases to restrict an insertion of the corresponding one of the first and second liquid containers into the corresponding one of the first and second cases at a particular position before the corresponding one of the first and second liquid containers is inserted into the first or second mounted position, respectively, and a refracted position in which the protruding member is retracted from the corresponding insertion path formed in the corresponding one of the first and second cases to allow the insertion of the corresponding one of the first and liquid containers up to the first or second mounted position;

a first link member and a second link member provided at the first protruding member and the second protruding member, respectively, wherein each of the first link member and the second link member is configured to change a position of the corresponding one of the first and second protruding members from the protruding position to the retracted position when the corresponding one of the first and second levers moves from the first position to the third position; and a first allowing/preventing member configured to allow a positional change of the first lever from the first position to the third position when the first liquid container is inserted into the first case, and to prevent the positional change of the first lever from the first position to the third position when the second liquid container is inserted into the first case; and a second allowing/preventing member configured to allow a positional change of the second lever from the first position to the third position when the second liquid container is inserted into the second case, and to prevent the positional change of the second lever from the first position to the third position when the first liquid container is inserted into the second case.

2. The storage device according to claim 1, wherein the each of the first and second allowing/preventing members comprises a first engagement portion that is disposed on the corresponding one of the first and second levers, wherein each of the first and second liquid containers comprises a second engagement portion that is formed at a position corresponding to the first engagement portion of the corresponding one of the first and second allowing/preventing members and is formed on a first surface of the corresponding one of the first and second liquid containers where the corresponding one of the first and second levers contacts during the positional change of the first or second lever from the first position to the second position.

3. The storage device according to claim 2, wherein each of the first and second levers is allowed to reach the third position when the first engagement portion of the corresponding one of the first and second allowing/preventing members is engaged with the second engagement portion of the corresponding one of the first and second liquid containers during the positional change of the first or second lever from the first position to the third position.

4. The storage device according to claim 3, wherein the first engagement portion is a recess, and the second engagement portion is a projection.

5. The storage device according to claim 4, wherein, when the first liquid container is inserted into the second case, the projection of the first liquid container abuts a portion of the second lever except where the recess is formed during the positional change of the second lever from the first position to the third position so that the second lever is prevented from reaching the third position, and when the second liquid container is inserted into the first case, the projection of the second liquid container abuts a portion of the first lever except where the recess is formed during the positional change of the first lever from the first position to the third position, such that the first lever is prevented from reaching the third position.

6. The storage device according to claim 3, wherein the first engagement portion is a projection, and the second engagement portion is a recess.

7. The storage device according to claim 6, wherein, when the first liquid container is inserted into the second case, the projection of the second lever abuts a portion of the first surface of the first liquid container except where the recess is formed, such that, during the positional change of the second lever from the first position to the third position, the second lever is prevented from reaching the third position, and when the second liquid container is inserted into the first case, the projection of the first lever abuts a portion of the first surface of the second liquid container except where the recess is formed, such that, during the positional change of the first lever from the first position to the third position, the first lever is prevented from reaching the third position.

8. The storage device according to claim 1, further comprising:

a first supporting member and a second supporting member that slidably support the first and second protruding members, respectively, between the projecting position and the retracted position; and a first elastic member and a second elastic member disposed on the first and second supporting members, respectively, and configured to elastically urge the corresponding one of the first and second protruding members in a direction in which the corresponding one of the first and second protruding members projects into the insertion path formed in the in the corresponding one of the first and second cases;

wherein each of the first and second link members is configured to compress the corresponding one of the first and second elastic in accordance with the positional change of the corresponding one of the first and second levers from the first position to the third position, and each of the first and second link members is configured to release compression of the corresponding one of the first and second elastic members in accordance with the positional change of the corresponding one of the first and second levers from the third position to the first position.

9. The storage device according to claim 1, wherein each of the first and second liquid containers has a liquid supply opening covered with a liquid supply cover member, liquid stored in the liquid container capable of being drawn from the liquid supply opening, wherein each of the first and second cases comprises a liquid extraction portion configured to open the liquid supply cover member when the corresponding one of the first and second liquid containers is positioned at the first or second mounted position, and each of the corresponding one of the first and second protruding members in the protruding position prevents the insertion of the corresponding one of the first and second liquid containers into the corresponding one of the first and second cases before the liquid opening is opened.

10. The storage device according to claim 9, wherein the liquid supply opening is formed on a wall surface on a forward side of each of the first and second liquid containers with respect to a first direction, the first direction corresponding to the insertion direction when each of the first and second liquid containers is inserted into the corresponding one of the first and second cases, and wherein the liquid extraction portion is disposed on a deeper side of each of the first and second cases in the insertion direction.

11. The storage device according to claim 1, wherein each of the first and second liquid containers comprises a restricting portion formed on a surface that faces the corresponding one of the first and second protruding members when the liquid container is inserted into the corresponding one of the first and second cases, wherein each of the first and second protruding members in the protruding position contacts the restricting portion of the corresponding one of the first and second liquid containers when the corresponding one of the first and second liquid containers is positioned at the particular position to prevent a further insertion of the corresponding one of the first and second liquid containers.

12. The storage device according to claim 11, wherein each of the first and second liquid containers comprises a guide groove extending along a first direction corresponding to the insertion direction when the liquid container is inserted into the corresponding one of the first and second cases, wherein each of the first and second protruding members is fitted to the corresponding guide groove to guide the corresponding one of the liquid containers in the insertion direction, wherein an upstream end of the corresponding guide groove with respect to the first direction comprises the restricting portion.

* * * * *